United States Patent [19]

Hieftje et al.

[11] Patent Number: 4,492,322

[45] Date of Patent: Jan. 8, 1985

[54] DEVICE FOR THE ACCURATE DISPENSING OF SMALL VOLUMES OF LIQUID SAMPLES

[75] Inventors: Gary M. Hieftje; John Shabushnig, both of Bloomington, Ind.

[73] Assignee: Indiana University Foundation, Bloomington, Ind.

[21] Appl. No.: 373,647

[22] Filed: Apr. 30, 1982

[51] Int. Cl.[3] ..... B67D 5/00

[52] U.S. Cl. ..... 222/420; 209/644; 239/102; 346/75

[58] Field of Search ..... 209/3.1, 3.2, 3.3, 644; 222/420; 239/102; 346/75

[56] References Cited

U.S. PATENT DOCUMENTS

| | | | |
|---|---|---|---|
| 2,392,072 | 1/1946 | Vang | 83/91 |
| 2,779,623 | 1/1957 | Eisenkraft | 299/1 |
| 2,928,409 | 3/1960 | Johnson et al. | 137/82 |
| 3,325,858 | 6/1967 | Ogden et al. | 12/2.7 |
| 3,373,232 | 3/1968 | Wise et al. | 264/9 |
| 3,648,929 | 3/1972 | Corbaz | 239/102 |
| 3,700,170 | 10/1972 | Blanka et al. | 239/102 |
| 3,731,850 | 5/1973 | Weitzel et al. | 222/193 |
| 3,810,779 | 5/1974 | Pickett et al. | 117/37 |
| 3,958,249 | 5/1976 | DeMaine et al. | 346/1 |
| 4,043,507 | 8/1977 | Wace | 239/102 |
| 4,190,844 | 2/1980 | Taylor | 346/75 |
| 4,341,310 | 7/1982 | Sangiovanni et al. | 222/420 X |

OTHER PUBLICATIONS

"Device for the Accurate Dispensing of Small Volumes of Liquid Samples", J. G. Shabushnig and G. M. Hieftje, Abstracts to the 1980 Pittsburgh Conference.

"A Droplet Generator With Electronic Control of Size, Production Rate, and Charge", Abbott, C. E. and T. W. Cannon, *Rev. of Scientific Instruments*, 43 (1972), 1313.

K. R. Millar, F. Cookson & F. M. Gibb, *Lab Pract.*, 28 (1979), 752.

E. H. Pals, D. N. Baxter, E. R. Johnson & S. R. Crouch, *Chem., Biomed., & Environ. Instr.*, 9 (1979), 71.

V. Sacchetti, G. Tessari & G. Torsi, *Anal. Chem.*, 48 (1976), 1175.

F. J. M. J. Maessen, F. D. Posma & J. Balke, *Anal. Chem.* 46 (1974), 1445.

G. M. Hieftje & H. V. Malmstadt, *Anal. Chem.*, 40 (1968), 1860.

G. M. Hieftje & H. V. Malmstadt, *Anal. Chem.*, 41 (1969), 1735.

B. M. Joshi & R. D. Sacks, *Anal. Chem.*, 51 (1979), 1786.

G. J. Bastiaans & G. M. Hieftje, *Anal. Chem.*, 45 (1973), 1994.

G. M. Hieftje & B. M. Mandarano, *Anal. Chem.*, 44 (1972), 1616.

T. W. Hunter, J. T. Sinnamon & G. M. Hieftje, *Anal. Chem.*, 47 (1975), 497.

*Primary Examiner*—Charles A. Marmor
*Attorney, Agent, or Firm*—Kirkland & Ellis

[57] ABSTRACT

A device for accurately dispensing small volumes of liquids in the form of uniform droplets. The dispensing device communicates with a source of compressed air which, during start-up transience of the dispensing device, directs a jet of compressed air at the trajectory of dispensed droplets, thereby deflecting the droplets out of their normal trajectory and away from the collecting surface or container and allowing accurate dispensing.

1 Claim, 2 Drawing Figures

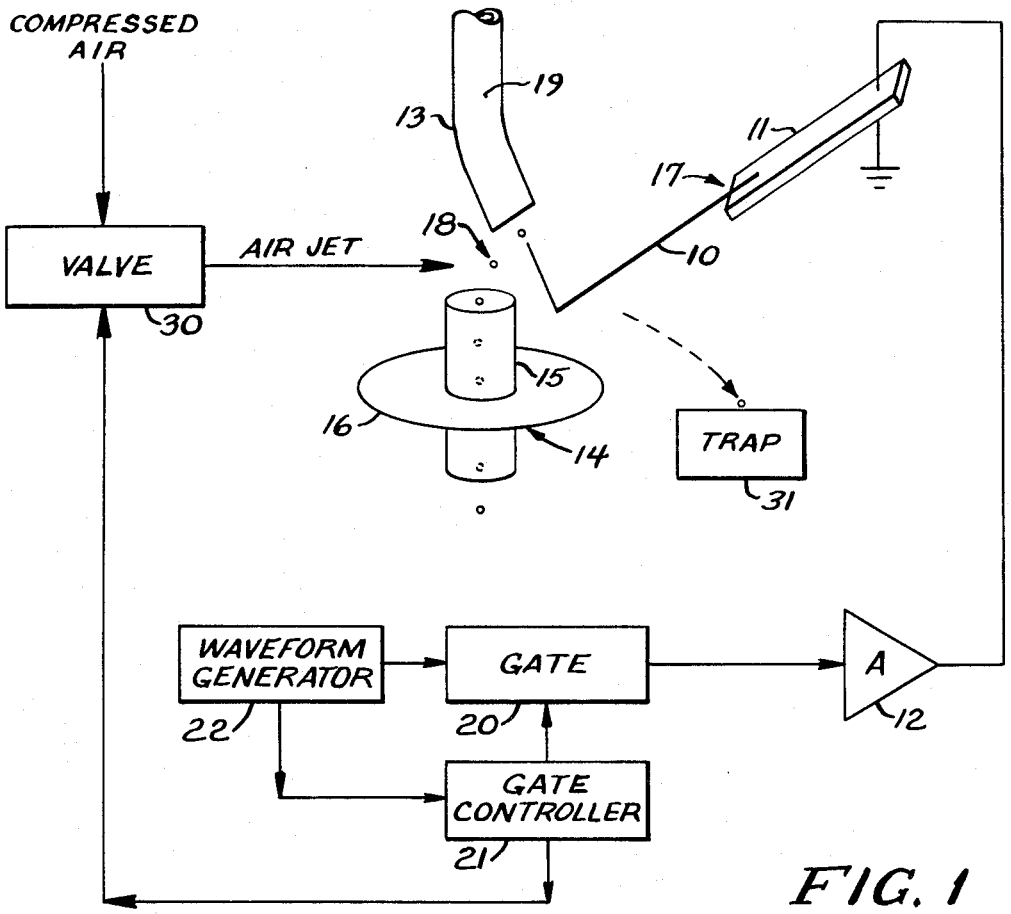
FIG. 1
FIG. 2
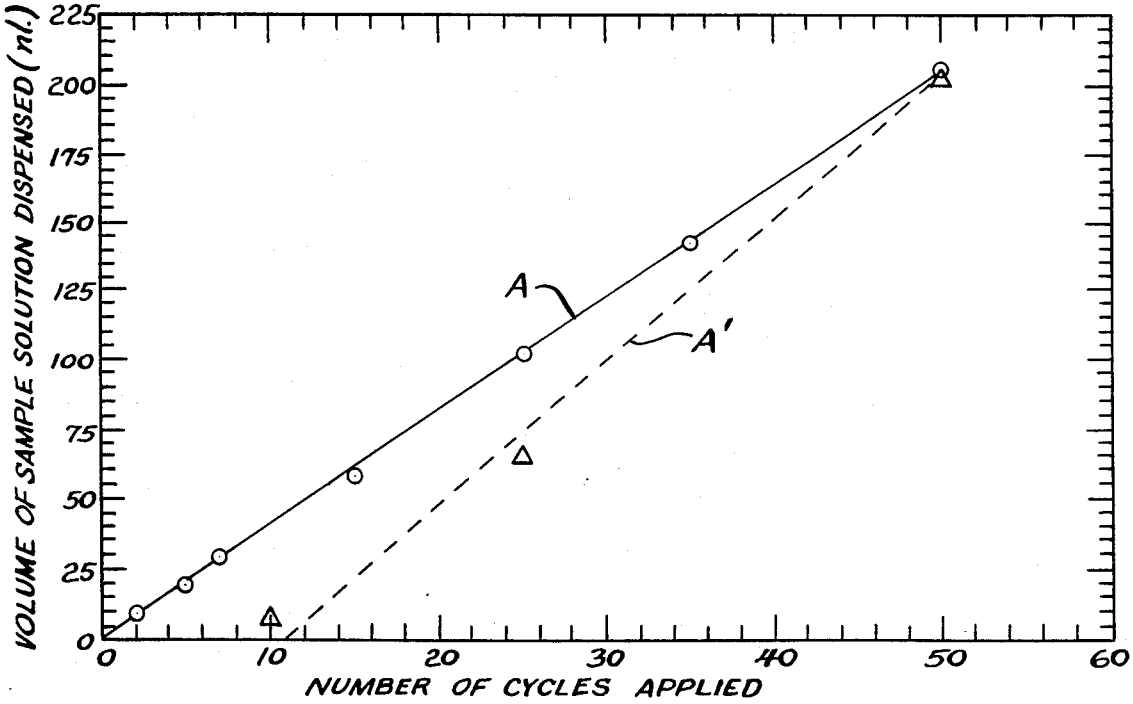

DEVICE FOR THE ACCURATE DISPENSING OF SMALL VOLUMES OF LIQUID SAMPLES

BACKGROUND OF THE INVENTION

1. Field of the Invention

The subject invention relates generally to a device for dispensing small volumes of liquids in the form of droplets and more specifically to a dispensing device which utilizes a source of compressed air to eliminate start-up transience.

2. Background Art

Many analytical techniques require the accurate and precise application or delivery of small volumes of liquid samples. In order to meet these needs, various syringe-based dispensers have been designed, K. R. Millar, F. Cookson & F. M. Gibb, *Lab. Pract.*, 28 (1979) 752; E. H. Pals, D. N. Baxter, E. R. Johnson & S. R. Crouch; *Chem., Biomed., & Environ. Instr.*, 9 (1979) 71; V. Sacchetti, G. Tessari & G. Torsi, *Anal. Chem.*, 48 (1976) 1175. However, these devices are generally limited to delivering volumes of one microliter or larger and are not amenable to rapid, electronic control of the volume dispensed. They also often suffer from irreproducible transfer of the sample to a surface, such as that of an electrothermal atomizer, F. J. M. J. Maessen, F. D. Posma & J. Balke, *Anal. Chem.*, 46 (1974) 1445.

Tiny samples in the form of microdroplets, typically 50–100 micrometers in diameter, were used by several researchers in the study of atomization processes in chemical flames G. M. Hieftje & H. V. Malmstadt, *Anal. Chem.*, 40 (1968) 1860; G. M. Hieftje & H. V. Malmstadt, *Anal. Chem.* 41 (1969) 1735; B. M. Joshi & R. D. Sacks, *Anal. Chem.*, 51 (1979) 1781, and as a means of sample introduction for quantitative analysis, G. J. Bastiaans & G. M. Hieftje, *Anal. Chem.*, 45 (1973) 1994. Microdroplets have also been employed for titrant delivery in micro-titrations, G. M. Hieftje & B. M. Mandarano, *Anal. Chem.* 44 (1972) 1616; T. W. Hunter, J. T. Sinnamon & G. M. Hieftje, *Anal. Chem.*, 47 (1975) 497.

The use of a microdroplet generator for sample delivery is attractive primarily because of the wide range of volumes which can be accurately dispensed and the ease with which this volume can be controlled by varying the number of droplets generated. Unfortunately, most devices used to generate microdroplets are not convenient to use and require substantial bulk volumes from which the droplets are extracted. Such devices form droplets by forcing the desired solution through a vibrating capillary or orifice and sonically decomposing the resulting jet into a stream of droplets. This method requires relatively large amounts of sample solution, is prone to failure from capillary clogging, and expels microdroplets with considerable velocity, making them hard to control and encouraging droplet splashing or shattering. In addition, microdroplet generators also suffer from a significant level of hysteresis upon start-up which adversely affects the accuracy of liquid volumes initially produced by the generator. The prior art offers no satisfactory method for dealing with these initial, non-uniform microdroplets.

SUMMARY OF THE INVENTION

In order to overcome these difficulties, a new kind of microdroplet-generator-based sample dispenser has been designed. This system generates microdroplets by rapidly withdrawing a glass stylus from an aliquot of sample solution contained in a suitable reservoir. The microdroplets fall in a reproducible trajectory and are easily collected on a surface or in a container.

An air jet is provided in combination with the stylus in order to deflect the non-uniform microdroplets formed during start-up. Thus, during the initial (approximately one-hundred) cycles of the stylus, the air jet directs compressed air at the microdroplet trajectory, thereby forcing the microdroplets out of their normal trajectory and away from the collecting surface or container.

BRIEF DESCRIPTION OF THE DRAWINGS

FIG. 1 is a schematic diagram of the preferred embodiment of the present invention.

FIG. 2 is a graphical representation of the liquid volume dispensed as a function of the number of cycles applied both with and without the air jet feature.

DETAILED DESCRIPTION OF THE PREFERRED EMBODIMENT

With reference to FIG. 1, the stylus 10 is preferably solid, drawn borosilicate glass with a main shaft 0.5 mm in diameter ×30 mm long and a tip 120 micrometers in diameter×10 mm long. These specific dimensions are not critical, but have proven convenient in routine use. It will be understood that stylii having other dimensions may be employed with satisfactory results. The stylus 10 is driven by a ceramic piezoelectric bimorph 11 mounted in a cantilever configuration. The stylus 10 is affixed to the bimorph 11, preferably with epoxy cement, and can be accurately positioned with respect to the reservoir by means of a vertical screw translator (not shown). A suitable bimorph is the model PZT-5H manufactured by Vernitron Piezoelectric Division, Bedford, Ohio.

The bimorph 11 is driven by an amplifier 12 supplying a sine wave at the resonant frequency of the bimorph-stylus combination 17, which is preferably 157 Hz at 100 V peak-to-peak. The resonant frequency is required in order to produce sufficient deflection of the stylus 10 for microdroplet formation.

Microdroplets 18 are formed by rapidly inserting and withdrawing the stylus 10 from the open end of the reservoir tube 13. As the stylus 10 withdraws, it pulls with it a filament of solution 19 from the reservoir. Upon further withdrawal of the stylus 10, the filament detaches itself first from the stylus 10, and then from the bulk of solution 19 remaining in the reservoir. This filament then collapses upon itself, forming a microdroplet 18 which falls from the apparatus. A reservoir tube 13, preferably a 4-cm long section of 2-mm i.d. glass tubing, holds the sample solution 19 by capillary action. If a large volume of the sample solution 19 is to be employed or many repetitive volumes of the sample solution 19 are to be dispensed, the reservoir tube 13 can be coupled to a larger vessel through a siphon.

A baffle 14, preferably a 25-mm section of 6-mm i.d. glass tubing 15 placed through the center of an aluminum disk 16, preferably 40 mm in diameter, is positioned to permit the normal trajectory of the falling microdroplets 18 to freely pass through the center of the baffle 14 or, in the preferred embodiment, the center of the glass tubing 15. The baffle 14 serves to shield the falling microdroplets 18 from air currents, thereby making their trajectory, and therefore the location of sample deposition, more reproducible.

The amplifier 12 receives a signal from a waveform generator 22. The signal passes through an electronic gate 20 which allows the operator to select the exact number of microdroplets which are dispensed. Each cycle of the bimorph driving wave from the waveform generator 22 produces a single microdroplet 18. In turn, the number of driving wave cycles is controlled by a preset value in the gate controller 21, which opens the gate 20 between the waveform generator 22 and amplifier 12 for the duration of the requisite number of cycles. In routine use, the volume of sample solution 19 which is dispensed is related to the number of bimorph driving cycles through a calibration curve or measured microdroplet volume as illustrated by the graph in FIG. 2. Thus, the user may select the volume to be dispensed by setting the gate controller 21 accordingly. This hardware scheme could easily be duplicated under software control with a small laboratory computer or microprocessor.

The gate controller 21 also controls a valve 30, preferably a solenoid valve, which directs a jet of compressed air at the stream of microdroplets 18 formed by the bimorph-stylus combination 17. A suitable valve is the model 339-V-12-5 12-V solenoid valve manufactured by Angar Scientific, East Hanover, N.J. The displaced microdroplets may be deflected by the air jet into a trap 31 and recovered for subsequent use.

FIG. 2 shows the volume of sample solution dispensed as a function of the number of cycles applied. Line A represents the volume of microdroplets generated with the air jet operating. The air jet was not employed in obtaining the values for line A'. It will be appreciated from a comparison of line A with line A' that the introduction of an air jet overcomes the unacceptable non-uniformity of microdroplet volume encountered during the initial 100 cycles of operation when the bimorph 11 exhibits a significant level of hysteresis. The linear relationship between the total volume of liquid dispensed and the number of cycles applied at steady state is shown by line A in FIG. 2.

While the preferred embodiment of the invention has been illustrated and described, it is to be understood that the invention is not limited to the precise construction herein disclosed, and the right is reserved to all changes and modifications coming within the scope of the invention as defined in the appended claims.

We claim:

1. An apparatus for accurately dispensing small volumes of a liquid sample, which comprises:

a reservoir tube with an open lower end for holding a liquid sample;

stylus means responsive to a drive signal for forming and releasing droplets of said liquid sample by insertion into and withdrawal from said open lower end of said reservoir tube;

a baffle for shielding said droplets from air movement thereby preventing deflection of the droplets from their desired trajectory, said baffle comprising a tube and a shield for catching droplets that do not pass through the tube; and driving means for generating said drive signal for driving said stylus means.

* * * * *